United States Patent [19]

Klein

[11] 4,005,499

[45] Feb. 1, 1977

[54] INDIVIDUALIZED BED COVERING

[76] Inventor: Miriam Travis Klein, 6416 Landview Road, Pittsburgh, Pa. 15217

[22] Filed: Mar. 12, 1976

[21] Appl. No.: 666,319

[52] U.S. Cl. ..... 5/334 R

[51] Int. Cl.[2] ..... H47G 9/00

[58] Field of Search ..... 5/334 R, 334 C, 335, 5/347

[56] References Cited

UNITED STATES PATENTS

| | | | |
|---|---|---|---|
| 2,730,728 | 1/1956 | Roberts | 5/334 R |
| 3,154,798 | 11/1964 | Harris et al. | 5/347 |
| 3,530,516 | 9/1970 | Marquette | 5/334 R |

*Primary Examiner*—Paul R. Gilliam
*Assistant Examiner*—Andrew M. Calvert
*Attorney, Agent, or Firm*—Parmelee, Miller, Welsh & Kratz

[57] ABSTRACT

A bed covering such as a blanket or sheet is provided with two separately cleanable and washable halves or parts, to be utilized independently and with tie means for removably connecting the parts together to form a complete assembly. Each part has its own individual characteristics suited to the needs of two persons, for example, sleeping in a double bed. The connecting means is of a type that facilitates cleaning or washing without damage to the covering and each part is provided with pocket means for removably carrying an individualized treated pad or packet.

7 Claims, 7 Drawing Figures

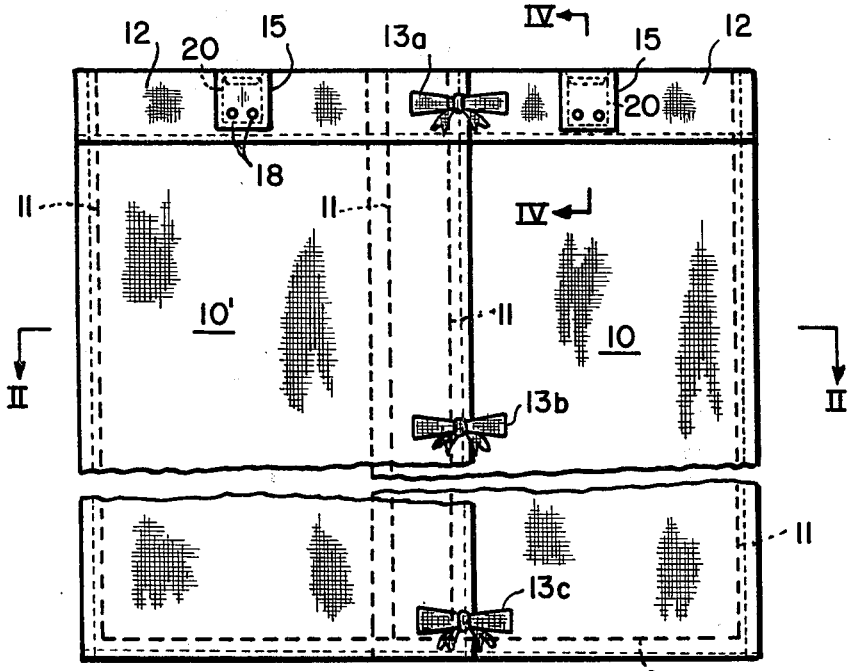
Fig. 1
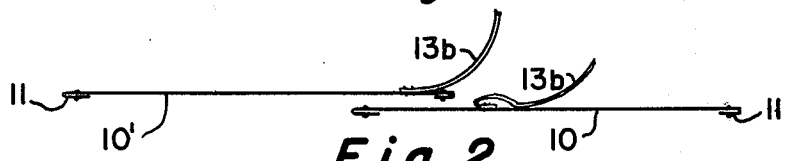
Fig. 2
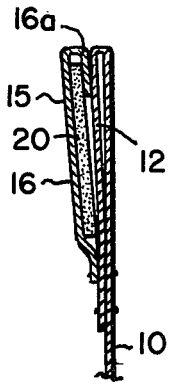
Fig. 4
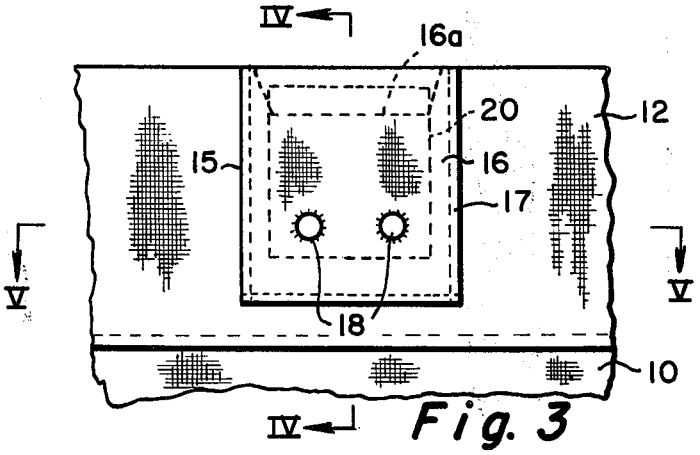
Fig. 3
Fig. 5
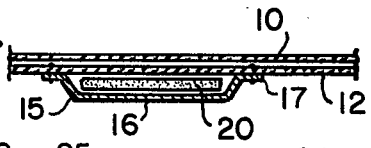
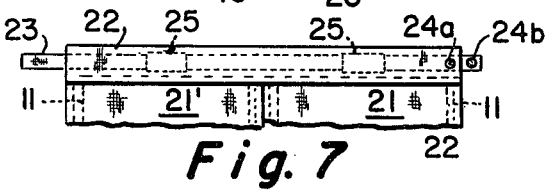
Fig. 7
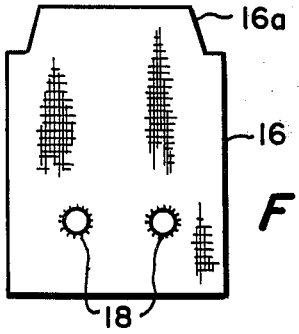
Fig. 6

INDIVIDUALIZED BED COVERING

BACKGROUND OF THE INVENTION

Field of the Invention

This invention pertains to a bed covering whose body parts are easily assembled and disassembled, and whose body parts are of a nature such as to be relatively immune to damage by washing or cleaning equipment. The invention deals particularly with an improved individualized fabric bed covering that is suitable for multi-occupancy and that may be given an aura suitable for or according to the taste of the individual using the particular body part involved.

Description of the Prior Art

Heretofore, bed coverings such as blankets and sheets have been provided in the form of a bottom connected portion that is centrally slit downwardly from its upper end or with portions that are fully separable along the length extent thereof, in order to enable each person occupying a double bed to fully use his portion, for example, as a partial or full covering. Although a two-part covering has been designed for an electric blanket installation, this has no particular advantage in view of the fact that each half may be provided with its own heating unit and temperature control.

Such constructions have not come into general usage in spite of the need for an individualized bed covering. On investigation, I found that metal or resin, slide, snap or zip fasteners of relatively hard material are objectionable to the user of a bed covering and have also given rise to difficulties in their utilization after the covering has been processed through cleaning, washing or ironing equipment. Such types of fastening devices are easily damaged by cleaning and washing operations, particularly in view of the length of the bed covering which further makes a so-called slide type of fastener very expensive.

In fully evaluating the situation, it was found that the need for such a type of covering could by met by a relatively inexpensive construction of fully soft, fabric-like material that is relatively indestructible in its utilization from the standpoint of the equipage used in frequent cleaning-processing. Also, I have found that there has been a need for a covering which can be used to provide a controlled favorable aura, fragrance, scent, odor, bouquet or perfume to induce restful sleep and, if desired, provide medical treatment for the bed user. In this connection, it has been determined that such means should be individualized for separate parts of the covering to suit the particular requirement of each individual occupying the half of a bed. It was discovered that a direct application of liquid perfume drops or a powder to a pair of body parts of a bed cover is not satisfactory, in that the concentration is too great and the stronger perfume will tend to dominate and permeate both sides of the bed, mixing with the scent of the other part to provide an unacceptable composite scent.

SUMMARY OF THE INVENTION

It has thus been an object of the invention to discover the factors which have heretofore limited the usage of a multi-part bed covering and to provide a fully soft practical type that is essentially easily cleaned-processed without damage to its elements.

Another object has been to devise an inexpensive improved type of dual-part bed covering in which each half may not only be individualized from the standpoint of the fabric, woof or texture and color, but also from the standpoint of a localized aura or scent.

A further object of the invention has been to provide improved dual-part bed coverings in the nature of sheets and blankets in which each part thereof may have a separate treated pad or sachet-containing pocket that will facilitate a controlled individualized use of different scents as desired.

These and other objects of the invention will appear to those skilled in the art from the specification and drawings.

BRIEF DESCRIPTION OF THE DRAWINGS

In the drawings,

FIG. 1 is a greatly reduced broken-away top plan view illustrating a preferred embodiment of the cover invention in an assembled, bed-mountable relation;

FIG. 2 is a cross sectional view on the scale of FIG. 1 and taken along the line II—II of FIG. 1;

FIG. 3 is an enlarged top fragment of the cover of FIG. 1 particularly illustrating the mounting and construction of a pad-receiving pocket;

FIG. 4 is an enlarged side edge fragment in elevation on the scale of FIG. 2 and taken along the line IV—IV of FIGS. 1 and 3;

FIG. 5 is a cross sectional fragment on the enlarged scale of and taken along the line V—V of FIG. 3; this view shows an absorbent or sachet-like pad in position with its pocket;

FIG. 6 is a plan view on the scale of FIGS. 3, 4 and 5, showing patch-like fabric material that is shaped to provide front and top flap portions of a pocket particularly illustrated in FIGS. 3 to 5, incusive;

And FIG. 7 is a fragmental top plan view on a reduced scale with respect to FIG. 1, illustrating a modified construction embodying the invention.

DESCRIPTION OF THE PREFERRED EMBODIMENT

In FIG. 1 of the drawings, an assembled bed covering of the invention is shown made up of relatively soft, fabric or cloth-like parts or halves 10 and 10' of substantially identical construction. To simplify the description, reference will thus be made primarily to the right hand half or part 10 of this figure. A relatively narrow stitched hem 11 is shown extending along the two opposite side length portions or edges, as well as across the bottom edge or end portion of the cover part 10. These cooperate with a widened, stitched selvage edge portion 12 at the upper edge or end thereof. It will be noted that the selvage edge portion 12 is provided by folding-over an upper width portion of the covering and stitching it in place.

To connect the two parts or halves 10 and 10' together, each part 10, 10' is shown provided with sewn-on, short length, lengthwise spaced-apart, ribbon, fillet or cloth tie pieces or portions represented as top portion **13*a*, intermediate portion 13*b* and lower or bottom portion 13*c*. The tie portions of the parts 10 and 10' are in substantial alignment with each other to enable them to be tied together, as in the form of a bow, as disclosed in FIG. 1**. During usage one or more of the bows may be readily untied when, for example, one occupant of the bed wishes to dispense with his part of the covering.

FIGS. 3 to 6, inclusive, are illustrative of the construction of pockets 15 which may as shown be formed from a piece of patch-like fabric material 16 that is sewed in place on the selvage band or edge portion 12 within its width extent and at a substantially central location on the half 10 or 10', so as to provide an upper or top opening. If desired, each pocket may be lined with a moisture-resistant or treated material if, for example, a liquid-like perfume or medicine is to be used. As shown in FIGS. 4 and 5, the opening may be closed by a fold-over and in flap portion 16a of the pocket piece 16 to hold a small, treated, disc or pad-like, absorbent element, such as a scented sachet 20 in a retained and easily removable position therein. The pocket piece 16 is sewn in position along its opposite sides and bottom by a hem 17. A front wall of the pocket piece 16 is shown provided with a pair of spaced-apart, small breather holes or openings 18 therethrough to facilitate a limited escape of the scent which is provided by the inserted pad-like element 20. As indicated in FIGS. 3 and 6, each opening 18 may be reinforced by a continuous series of closely stitched thread loop portions thereabout of a type similar to those used in defining a button-hole.

From the above, it will be apparent that the covering of the invention is particularly suited to the use of larger beds in which two individuals wish to rest. It enables each individual to select his or her own type of covering, to use it in any manner desired, and to select and use a sachet packet (such as produced by Coty and others) that is pleasing to the individual and conducive to his or her slumber as used as a controlled sensory stimulus. The use of a small cotton or fabric inset or pad (instead of a sachet) treated with or soaked in an appropriate medicine has been found to be highly beneficial to persons or children having hay fever or a cold, for example. The construction eliminates all hard, rough or easily damaged elements that may be used for connecting the two parts of the covering or retaining the pad-like elements 20 within their pockets 16. As shown in FIG. 6, each fabric-like top wall portion of each pocket 16 has a fold-over flap portion 16a that is cut-in or cornered along its opposite side edges to facilitate its free endwise insertion within the top opening of the pocket (see FIGS. 4 and 6) and a removable retention of the pad 20 therein. The use of a fabric pocket with breather holes serves as a practical means for controlling the aura to provide it with a proper limited intensity in its closely adjacent position with respect to the head of a person employing the bed cover. The "in" location of the pad 20 and the positioning and construction of the pocket enables a substantial smell isolation of the aura provided by the pockets of a pair of assembled bed cover halves.

In the modified construction of FIG. 7, a top selvage edge portion 22 of each body part 21, 21' is open at its opposite ends to pass a tie piece means across adjacent lengthwise-extending side portions of the body parts therethrough and therebetween. As shown, the tie piece means is in the form of a ribbon length 23 which may be secured at its one end to the outer selvage end portion of one body part 21 by a flexible, soft, fastening means such as a fabric or soft rubber pin 24a and socket 24b snap fastener assembly or by a couple of thread stitches. The other end of the ribbon 23 may extend loosely from the opposite end of the selvage portion of the body part 21'. The ribbon 23 may, itself, be provided with aura-producing pads or discs 25 secured thereto that are, in effect, pocketed centrally within the selvage edge portion 22 of each bed covering body part. Frictional cloth retention resistance provided by the ribbon 23 within the selvage edge 22 may provide a sufficient retention of the bed covering body parts 21, 21' in an assembled relation. However, if a more positive retention is desired, a fastening means similar to the means above-mentioned may be provided at the outer, open end of the selvage edge portion 22 of the other body part 21'.

I claim:

1. In an improved two-part bed covering, a pair of longitudinally-extending fabric body parts that are adapted to be placed in a side-by-side lengthwise-aligned relation on the bed, each said body part having a relatively narrow hemmed edge along its opposed longitudinal side and transverse bottom portions and a relatively wide transverse selvage edge across its top portion, a pocket provided by said selvage edge, said pocket being adapted to receive and having means to removably retain a small treated pad-like element therein, said body parts having cooperating tie piece means extending therebetween across adjacent lengthwise-extending side portions thereof for removably securing them together in a bed covering assembly, said tie piece means being a ribbon secured at one end to the selvage edge of one of said body parts for extending within and along the selvage edges of both of said body parts, and a treated pad-like element carried by said ribbon within the selvage edge of at least one of said body parts.

2. An improved bed covering as defined in claim 1 wherein individually treated pad-like elements are carried by said ribbon within the selvage edge of both of said body parts.

3. In an improved bed cover for covering and providing an individualized aura for each of two persons lying on a bed, a pair of longitudinally extending fabric body-covering parts adapted to be placed in a lengthwise aligned relation on the bed as a surface covering therefor, said body parts having relatively narrow hemmed edges along their longitudinal sides and transverse bottom portions and a relatively wide transverse selvage edge across their top portions, a pair of individually scented pad-like elements, an open-end pocket provided by said selvage edge of each said body parts, each said scented element being adapted to be slid into and out of a removable secured position within an associated one of said pockets, one of said scented elements being adapted to provide a suitable individualized aura for the person who is covered by one of said body parts, and the other of said scented elements being adapted to provide a suitable individualized aura for the person who is covered by the other of said body parts.

4. In an improved bed covering as defined in claim 3, said selvage edge being open at its ends, a ribbon adapted to be introduced endwise into and along and to be removed from said selvage edge through its open ends, and said scented elements being secured on said ribbon in a spaced relation therealong for movement into and out of a substantially central position with respect to their associated said body parts.

5. In an improved bed covering as defined in claim 4, means for removably securing one end of said ribbon to the selvage edge of one of said body parts to extend across to and through and out of the selvage edge of the other of said body parts.

6. In an improved bed covering as defined in claim 3, each of said pockets being provided by a fabric patch sewed on the selvage edge of each of said body parts, and a flap carried by each said scented patch that is foldable into the associated said pocket for retaining said patch in a removable secure position therewithin.

7. In an improved bed covering as defined in claim 6, said foldable flap of each of said pockets being cut-in along its opposite side edges to facilitate its free endwise insertion within the top opening of the associated said pocket.

* * * * *